United States Patent [19]

Stern et al.

[11] Patent Number: 4,839,659

[45] Date of Patent: Jun. 13, 1989

[54] MICROSTRIP PHASE SCAN ANTENNA ARRAY

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 227,044

[22] Filed: Aug. 1, 1988

[51] Int. Cl.[4] ..... H01Q 00/00

[52] U.S. Cl. ..... 343/700 MS; 343/787; 343/788; 343/785

[58] Field of Search ..... 343/700 MS, 787, 788, 343/785; 342/371, 372; 333/158

[56] References Cited

U.S. PATENT DOCUMENTS

| | | | |
|---|---|---|---|
| H26 | 2/1986 | Dinger | 342/372 |
| 3,680,010 | 7/1972 | Buck | 333/158 |
| 3,868,694 | 2/1975 | Meinke | 343/785 |
| 4,458,218 | 7/1984 | Babbitt et al. | 343/158 |

*Primary Examiner*—Rolf Hille
*Assistant Examiner*—Hoanganh Le
*Attorney, Agent, or Firm*—Sheldon Kanars; Robert A. Maikis

[57] ABSTRACT

A microstrip phase scan antenna array is provided having a columnar array of microstrip radiating patches mounted on a dielectric substrate. Each column of the array is fed by a separate variable, reciprocal ferrite rod phase shifter which is mounted on the substrate and is coupled to the column which it controls and to a source of millimeter wave energy by microstrip to dielectric waveguide transitions. Each of the phase shifters is controlled by a helical biasing coil surrounding the ferrite rod. All of the biasing coils are serially interconnected by a single scanning control drive wire and the numbers of turns of the coils are related to each other by an arithmetic progression in which the number of turns of a particular biasing coil differs from the number of turns of the adjacent biasing coil in the sequence of biasing coils controlling the array by a constant amount.

7 Claims, 3 Drawing Sheets

MICROSTRIP PHASE SCAN ANTENNA ARRAY

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to electronic phase scan antennas for operation in the millimeter wave region of the frequency spectrum and more particularly to a microstrip phase scan antenna array for planar radar scanning in a single plane with a substantially pencil-shaped beam. 2. Description of the Prior Art Radar system antennas are customarily designed to be scanned in two, orthogonally-related planes, such as azimuth and elevation, for example. However, for certain applications, the antenna need only be scanned in a single plane because other means are available to provide scanning in the orthogonally-related plane. For example, if an antenna capable of scanning only in a single plane is mounted in a moving vehicle, such as an aircraft, a terminally-guided weapon or a remotely-piloted vehicle, and if the motion or track of the vehicle is along a path which is orthogonally-related to the scanning plane of the antenna, then scanning is effectively provided in two, orthogonally-related planes.

Since such single plane scanning antennas are often mounted in the moving vehicle itself, the size and weight of the antenna and its associated scanning system becomes very important. For example, when such antennas are used in aircraft, terminally-guided weapons and remotely-piloted vehicles, it is essential that the antenna and its scanning system be as compact as possible and of extremely small size and low weight. The antenna system should also be capable of being fabricated at a reasonable cost. Furthermore, for some applications, such as terminally-guided weapons, for example, it is desirable that the antenna system be conformal because conformal antennas can be bent or deformed to some degree to facilitate their mounting and placement in the limited space usually available in weapons of this type. Also of value for use in terminally-guided weapons of certain types are antenna arrays and associated scanning systems which are frangible because in these types of weapons, the antenna systems must be so mounted in the body of the guided weapon that it is directly in the path of a small projectile or charge which is fired through the antenna system before the impact of the weapon with the target.

Because of the aforementioned limitations, antenna systems which are mechanically scanned or driven are usually not feasible. Similarly, the electronically "steered" phase array systems which have been developed which do not rely upon mechanical scanning or drive mechanisms are generally very complex and bulky because a large number of phase shifting circuits are required for the individual antenna elements making up the array. With the advent of planar type circuitry which operates in the millimeter wave region of the frequency spectrum, microstrip antenna arrays have been developed which satisfy not only the aforementioned size and weight limitations but are also conformal and frangible. Unfortunately, however, the phase shifting circuits which must be employed to "steer" or scan the array are not available in microstrip circuitry.

SUMMARY OF THE INVENTION

It is an object of this invention to provide a microstrip phase scan antenna array for planar radar scanning in a single plane which is compact, small in size and low in weight.

It is a further object of this invention to provide a microstrip phase scan antenna array for planar radar scanning in a single plane which is of relatively simple construction and is relatively inexpensive to manufacture and maintain.

It is still further object of this invention to provide a microstrip phase scan antenna array for planar radar scanning in a single plane which is both conformal and frangible.

It is an additional object of this invention to provide a microstrip phase scan antenna array for planar radar scanning in a single plane which utilizes only a single scanning control wire to scan the entire array.

It is another object of this invention to provide a microstrip phase scan antenna array for planar radar scanning in a single plane which is especially suitable for use in millimeter wave radar systems for tanks, aircraft, terminally-guided weapons and remotely-piloted vehicles.

Briefly, the microstrip phase scan antenna array of the invention comprises a microstrip transmission line dielectric substrate having top and bottom surfaces, an electrically conductive ground plane mounted on the bottom surface of the substrate and a plurality of microstrip antenna radiating elements mounted on the top surface of the substrate in a columnar array of columns and rows of elements for radiating a substantially pencil-shaped beam in a first plane which is perpendicular to the columns of elements and in a second plane which is perpendicular to the first plane when the elements in each of the columns are serially interconnected and all of the columns are coupled to a source of millimeter wave energy. The sequence of the elements in each of the rows of elements defines the sequence of the columns in the array. A plurality of rectangular ferrite rods are mounted on the top surface of the substrate. The number of the rods is equal to the number of the columns in the array. Each of the rods has one side thereof mounted on the top surface of the substrate; a dielectric constant which is greater than the dielectric constant of the substrate; a dielectric plate mounted thereon having top and bottom surfaces and a dielectric constant which is substantially the same as the dielectric constant of the substrate, the plate extending the length of the rod and having the bottom surface thereof mounted on another side of the rod which is parallel to the first-named rod side; a pair of ramp-shaped dielectric waveguide members mounted on the top surface of the substrate at opposite ends of the rod, each of the ramp-shaped members having a dielectric constant which is substantially the same as the dielectric constant of the rod, a bottom surface abutting the top surface of the substrate, and a downwardly-sloping top surface extending between the end of the plate and the top surface of the substrate; and a length of electrically conductive microstrip conductor mounted on the top surfaces of the ramp-shaped members and the top surface of the plate and having an input end and an output end. Means for serially interconnecting the elements in each of the columns of elements are mounted on the substrate together with means for supplying the input ends of the microstrip conductor lengths associated with the plurality of rods with millimeter wave energy of equal amplitude and phase and for coupling the output end of each of the conductor lengths to a different one of the columns of elements so that the sequence of columns in the array is coupled to a sequence of the rods. Finally, means are provided for simultaneously magnetically biasing all of the rods along the longitudinal axes thereof to create magnetic biasing fields in the rods having simultaneous magnitudes which progressively increase from rod to rod in accordance with the sequential position of the rod in the sequence of rods, whereby the rods act as phase shifters to scan the antenna beam in the first plane. The simultaneous magnitudes of the magnetic biasing fields created in the sequence of rods are related to each other by an arithmetic progression in which the magnitude of the magnetic biasing field in each rod in the sequence of rods differs from the magnitude of the magnetic biasing field in an adjacent rod in the sequence of rods by a constant amount.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
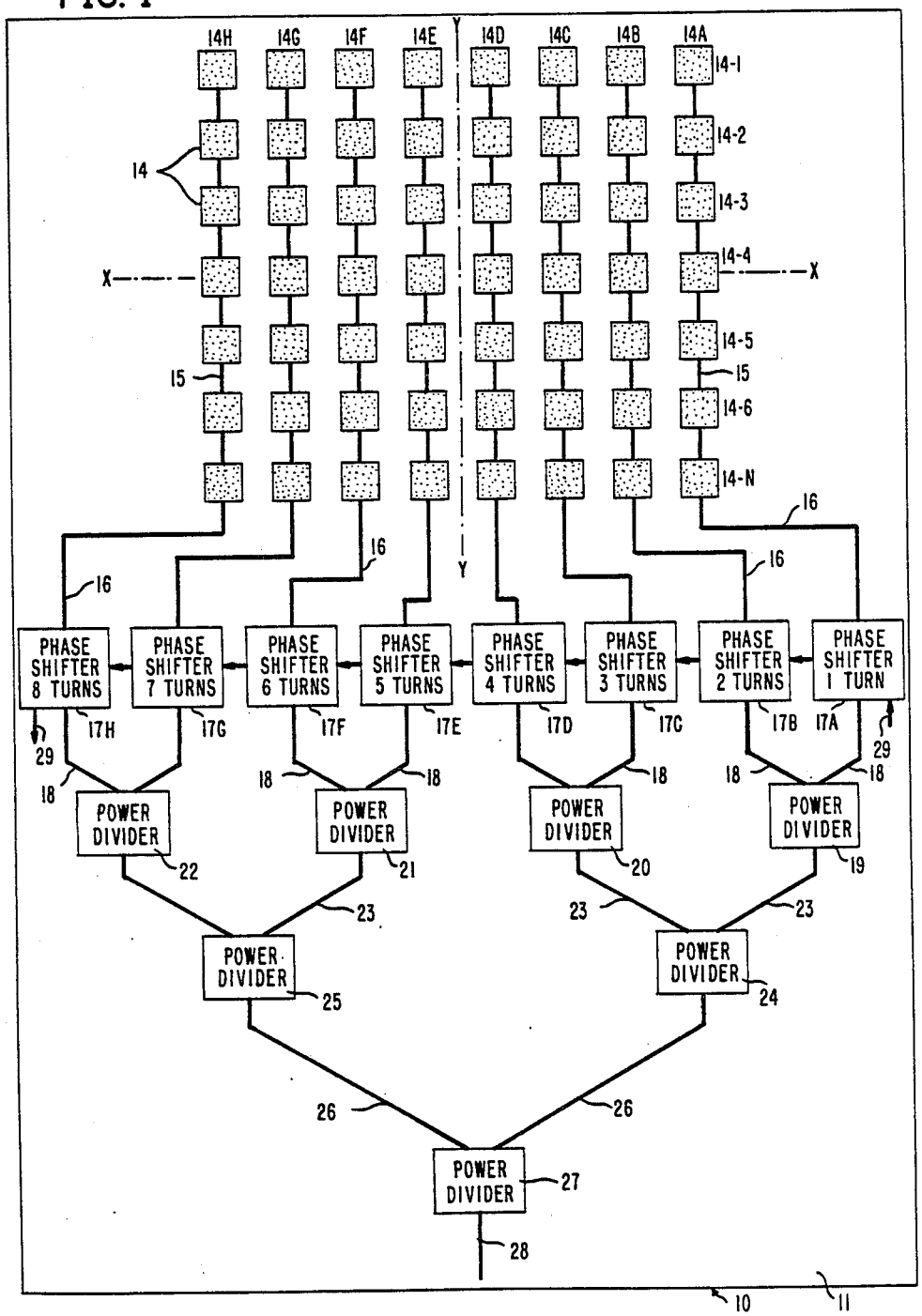
FIG. 1 is a schematic view of a microstrip phase scan antenna array constructed in accordance with the teachings of the present invention.
Figure 2:
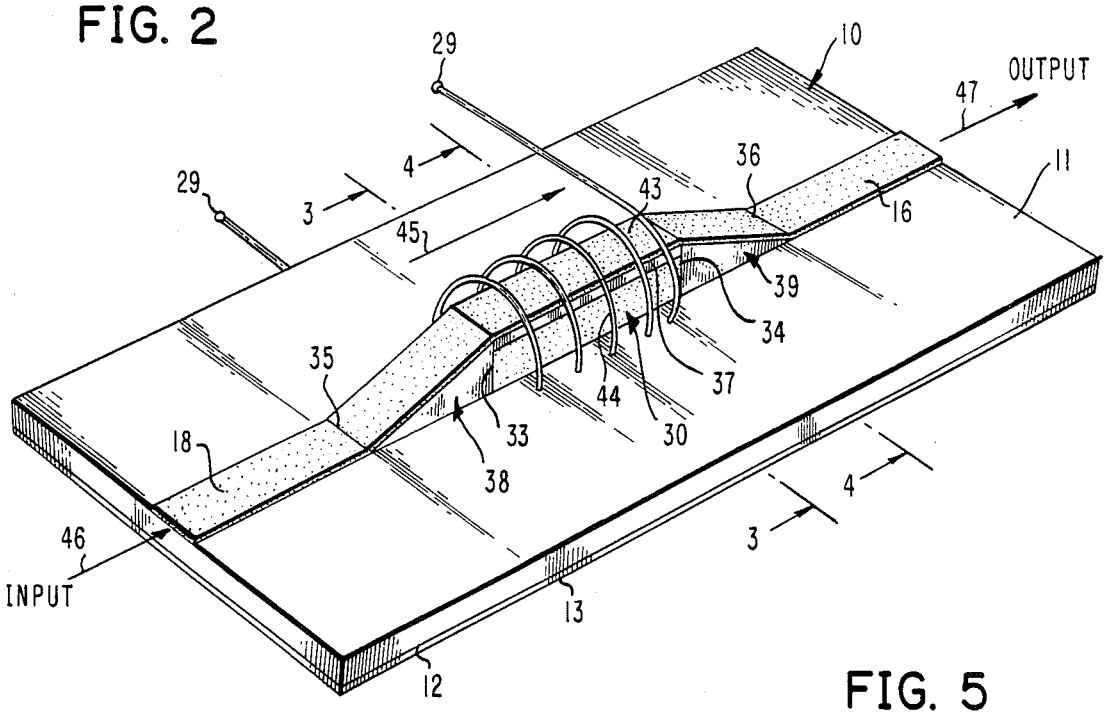
FIG. 2 is a perspective view of one of the microstrip phase shifters shown in FIG. 1 of the drawings.

Referring now to FIG. 1 of the drawings, the microstrip phase scan antenna array of the invention is shown as comprising a section of microstrip transmission line dielectric substrate, indicated generally as 10, upon which the array and associated scanning circuits are mounted. The substrate 10 may, for example, comprise a section of conventional microstrip substrate which is approximately 0.010 inch thick and which is fabricated of duroid or other similar dielectric material having a relatively low dielectric constant. A section of the substrate is shown in FIG. 2 of the drawings wherein it is seen that it has a planar top surface 11 and a planar bottom surface 12 upon which an electrically conductive ground plane 13 is mounted. The ground plane 13 should be fabricated of a good conducting metal, such as copper or silver, for example.

A plurality of microstrip antenna radiating elements 14 are mounted on the top surface 11 of the substrate 10 in a columnar array of eight columns designated 14A through 14H and seven rows designated as 14-1 through 14-N. The microstrip radiating elements 14 may comprise conventional and well known microstrip patch radiators, dipoles or slots, for example. The elements in each column of the array are serially interconnected by lengths 15 of conventional electrically conductive microstrip conductor and all of the columns in the array are coupled by lengths 16 of microstrip conductor to a plurality of phase shifters 17. The microstrip conductors should, of course, be fabricated of a good conducting metal such as copper or silver, for example.

Each column of the array is coupled to a different one of the phase shifters 17 and the phase shifters have been designated as 17A through 17H to indicate the particular column of the array to which the output of a particular phase shifter is coupled. For example, the serially-interconnected radiating elements 14 in column 14D of the array are coupled to the output of phase shifter 17D. The inputs of the phase shifters 17 are coupled by the lengths 18 of microstrip conductors to the outputs of four power dividers 19, 20, 21 and 22 and the inputs of the four power dividers are, in turn, coupled by lengths 23 of microstrip conductor to the outputs of two power dividers 24 and 25. The two power dividers 24 and 25 are coupled by microstrip conductor lengths 26 to the output of a single power divider 27 which has its input coupled by a microstrip conductor 28 to a source (not shown) of millimeter wave energy. Finally, a drive or scan control indicated at 29, links all of the phase shifters 17 to provide a control means for scanning the antenna beam.

The power dividers 19–22, 24, 25 and 27 are all well known, conventional microstrip power dividers which serve to divide a signal applied to the input of each power divider into two, equal output signals having the same amplitude and phase. Since the power dividers are arranged in a pyramidal fashion with respect to the input signal from the millimeter wave source, it is apparent that the eight output signals from the power dividers 19–22 will all be of the same amplitude and phase so that each of the phase shifters 17A through 17H will receive an input signal having the same amplitude and phase.

The above-described microstrip antenna array is well known in the art and may be designed, in accordance with known techniques, to produce a pencil-shaped antenna beam when each column of the array is energized by millimeter wave energy having the same amplitude and phase. The beam produced by the antenna would be pencil-shaped when viewed in either of two, orthogonally-related planes. The first plane is perpendicular to the longitudinal axes of the columns and also to the plane of the paper in FIG. 1. It is designated by the dot-dash line X—X in FIG. 1. The second plane is perpendicular to the first plane and also to the plane of the paper and is designated by the dot-dash line Y–Y in FIG. 1. Since, as is well known, it is the lengths of each column of the radiating elements 14 which determines the narrowness of the antenna beam as viewed in the Y–Y plane, the last row of elements of the columns has been designated "14-N". In general, however, the greater the number of radiating elements in the column, the narrower will be the beam. Similarly, it is the number of radiating elements in each row of the array or, expressed in another way, the number of columns in the array, which determines the narrowness of the beam in the X—X plane. Accordingly, the representation of the antenna array shown in FIG. 1 should be considered purely as a schematic diagram.

Figure 3:
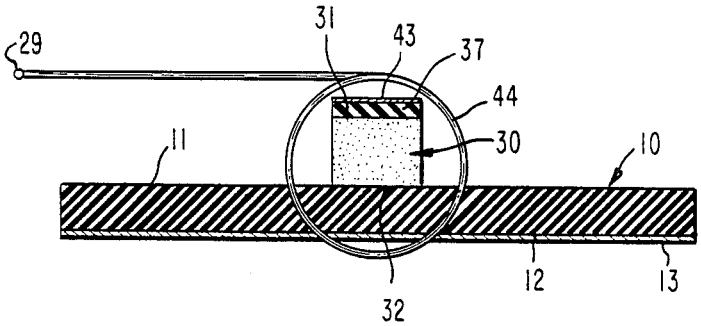
FIG. 3 is a full sectional view of the phase shifter of FIG. 2 taken along the line 3—3 of FIG. 2.

The antenna beam of the array illustrated in FIG. 1 is designed to be swept or scanned in the X—X plane. The scanning system for sweeping the beam comprises the eight phase shifters 17 and the drive control 29 which will now be described. Each of the phase shifters 17 is a microstrip reciprocal phase shifter having the same basic construction which is shown in FIGS. 2 through 5 of the drawings. As seen in FIGS. 2 and 3, each phase shifter comprises a ferrite rod, indicated generally as 30, which has a rectangular cross-section. The rod 30 has a top side 31 and a bottom side 32 and is mounted on the dielectric substrate 10 with the bottom side 32 of the rod abutting the top surface 11 of the substrate. The rod has ends 33 and 34 which are spaced approximately equidistant from the ends 35 and 36 of the microstrip conductors 18 and 16, respectively. The rod is fabricated of a ferrite material, such as nickel zinc ferrite or lithium zinc ferrite, for example, which exhibits gyromagnetic behavior in the presence of a unidirectional magnetic field. The dielectric constant of the ferrite rod 30 should be greater than the dielectric constant of the substrate 10. For example, if the substrate is fabricated of duroid, it would have a dielectric constant of 2.2 and if the ferrite rod is fabricated of nickel zinc ferrite, the rod would have a dielectric constant of 13.

Each of the phase shifters 17 has a dielectric plate 37 mounted thereon. The plate 37 extends the length of the rod and has its bottom surface mounted on the top side 31 of the rod which is, of course, parallel to the bottom side 32 of the rod. The dielectric constant of the plate 37 is preferably substantially the same as the dielectric constant of the substrate 10 and, for example, the plate may be conveniently fabricated of duroid. Although, for convenience of illustration, the thickness of the plate 37 is shown as being substantial in FIGS. 2 and 3, in practice the plate need only comprise a relatively thin plate.

Figure 5:
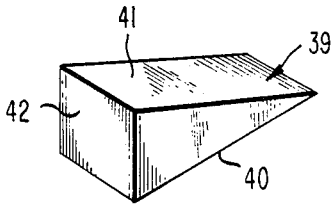
FIG. 5 is a perspective view of one of the ramp-shaped dielectric waveguide members shown in FIGS. 2 and 4.
Figure 4:
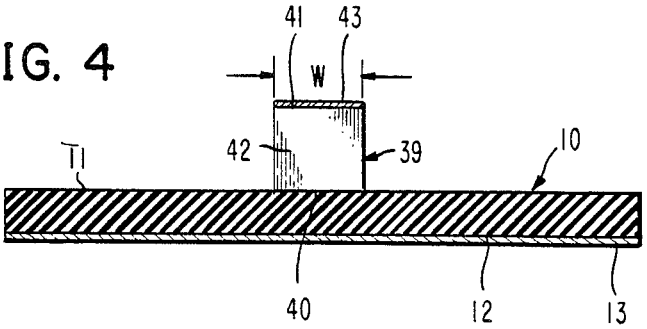
FIG. 4 is a full sectional view of the phase shifter of FIG. 2 taken along the line 4—4 of FIG. 2.

Each phase shifter also has a pair of ramp-shaped dielectric waveguide members, indicated generally as 38 and 39, which are mounted on the top surface 11 of the substrate at the opposite ends 33 and 34 of the rod and which are arranged to occupy the spaces between the ends 33, 34 of the rod and the ends 35, 36 of the microstrip conductors 18, 16 to which the phase shifter is coupled. Each of the ramp-shaped members 38, 39 has a width W, as seen in FIG. 4, which is substantially the same as the width of the rod 30, a planar bottom surface which abuts the top surface 11 of the substrate 10 and a downwardly-sloping planar top surface which extends between the ends of the dielectric plate 37 and the top surface of the substrate. For example, the ramp-shaped member 39 is shown in FIGS. 4 and 5 of the drawings and is seen to have a bottom surface 40 which abuts the top surface 11 of the substrate 10 and a downwardly-sloping planar top surface 41 which extends between the end of the plate 37 which is adjacent rod end 34 and the top surface 11 of the substrate. The end 42 of ramp-shaped member 39 abuts end 34 of the rod and the corresponding end of the dielectric plate 37. The ramp-shaped dielectric waveguide members 38 and 39 should be fabricated of a material having a dielectric constant which is substantially the same as the dielectric constant of the ferrite rod 30. For example, if the ferrite rod is fabricated of nickel zinc ferrite, the ramp-shaped members 38, 39 may be conveniently fabricated of magnesium titanate which also has a dielectric constant of 13. The ends 42 of the ramp-shaped members are preferably joined to the adjacent ends 33, 34 of the rod 30 by a low loss epoxy or adhesive such as Scotch-Weld Structural Adhesive as marketed by the 3M Company of St. Paul, Minn., for example.

A length of electrically conductive microstrip conductor 43 is mounted on the top surfaces 41 of the ramp-shaped members 38, 39 and the top surface of the plate 37 as seen in FIGS. 2, 3 and 4 of the drawings. The length 43 of microstrip conductor is electrically interconnected with the ends 35 and 36 of microstrip conductor lengths 18 and 16, respectively, by any convenient means, such as soldering, for example. Alternatively, the microstrip conductor lengths 16, 18 and 43 may comprise a single, integral length of microstrip conductor.

Each of the phase shifters 17 has means for applying a unidirectional magnetic field which extends along the longitudinal axis of the ferrite rod 30. As illustrated in FIGS. 2 and 3, the aforementioned means may take the form of a helical coil 44 which encircles the dielectric plate 37 and the ferrite rod 30 and extends along the length of the rod. As seen in FIG. 3 of the drawings, the turns of the coil 44 are embedded in and pass through the substrate 10 and also pass through small apertures (not numbered) in the ground plane 13. The turns of the coil should be spaced a distance from the ferrite rod 30 and the dielectric plate 37 with the microstrip conductor length 43 on its top surface for proper operation of the phase shifter. When the terminals of the coil 44 are connected to a source of d.c. voltage of proper polarity, a magnetic field represented by the arrow 45 will be created which extends the length of the ferrite rod 30. The magnitude and direction of the magnetic field 45 may be controlled by the amplitude and polarity, respectively, of the d.c. voltage applied to the coil terminals.

In operation, when a millimeter wavelength signal is applied to the input of each phase shifter, as represented by the arrow 46, it is transmitted along the first length 18 of microstrip conductor since that length in conjunction with the ground plane 13 and the dielectric substrate 10 form a section of a conventional microstrip transmission line. At end 35 of the conductor length 18, the applied signal passes along a microstrip transmission line which is formed by the portion of the microstrip conductor length 43 which is on the upwardly-sloping top surface 41 of the ramp-shaped member 38 and the ground plane and the dielectric substrate. However, as the signal is progressing up the incline it begins to become transmitted by the solid dielectric waveguide material of the ramp-shaped member 38 because the dielectric constant of the member 38 is substantially greater than the dielectric constant of the substrate 10. When the signal enters that portion of microstrip conductor 43 which is mounted on the dielectric plate 37, the signal becomes completely captured by the ferrite rod 30 which acts as a solid dielectric waveguide having the same or substantially the same dielectric constant as the ramp-shaped member 38. As seen in FIGS. 2 and 3 of the drawings, the ferrite rod 30 is "sandwiched" between the electrically conductive ground plane 13 and the microstrip conductor length 43 and is insulated from these conductive elements by the dielectric substrate 10 and the dielectric plate 37, respectively. Accordingly, when the ferrite rod 30 is subjected to a unidirectional magnetic field along its longitudinal axis, such as the field 45, for example, it will function as a reciprocal phase shifter because of the "suppressed rotation" or Reggia-Spencer effect in substantially the same manner as the dielectric waveguide phase shifter described in U.S. Pat. No. 4,458,218 which was issued July 3, 1984 to the Applicants of the present application and assigned to the assignee of the present application.

After the phase shifting action of the ferrite rod 30 takes place, the signal passes through the downwardly-sloping section of microstrip conductor length 43 which lies on ramp-shaped member 39 where transmission is gradually converted from the dielectric waveguide mode of transmission to the microstrip transmission line mode of transmission, so that by the time the signal passes along the length 16 of microstrip conductor and reaches the output of the phase shifter, as represented by arrow 47, it will again be completely in the microstrip transmission mode. A more complete description of the construction and operation of the aforementioned microstrip phase shifter may be found in U.S. Pat. Application Ser. No. 152,206 which was filed on Feb. 3, 1988, U.S. Pat. No. 4,816,787, by the same applicants as the present application and assigned to the same assignee as the present application.

Figure 6:
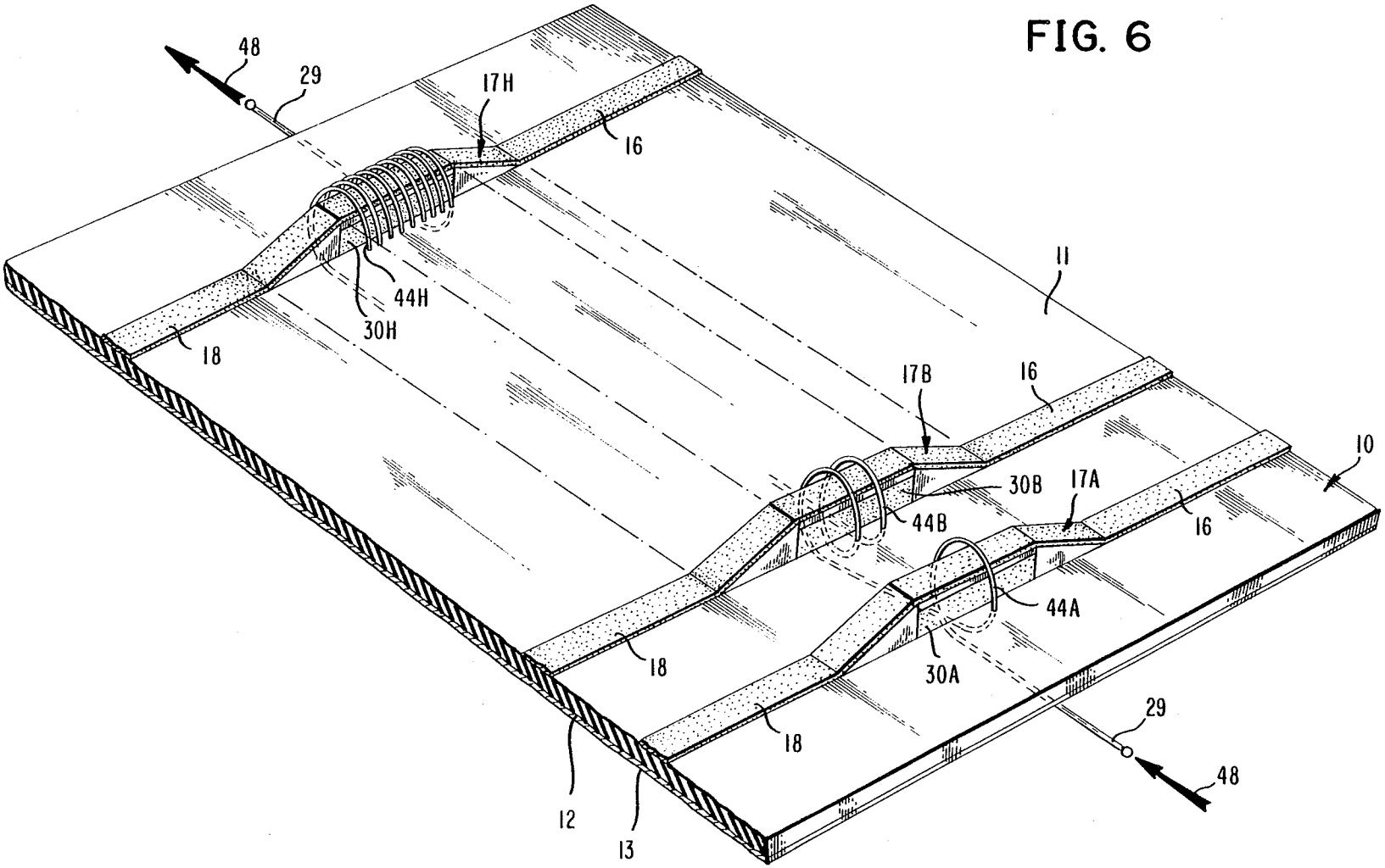
FIG. 6 is a perspective view showing three of the phase shifters of FIG. 1 in place on the dielectric substrate of the array, the remaining four phase shifters being omitted for convenience of illustration.

Referring now to FIG. 6 of the drawings, it will be seen that a plurality of the phase shifters 17 are mounted on the dielectric substrate 10. The ferrite rod 30 of each of the phase shifters 17 is aligned with the longitudinal axis of the particular column of antenna radiating elements 14 to which that phase shifter is coupled. This is done so that the lengths 15 of microstrip conductor which link the phase shifters to the columns of the array will all be substantially parallel to each other and of the same length so that no extraneous or unwanted phase shift is introduced by the location of the conductors 16 themselves. Accordingly, any phase shift in the millimeter wave signal which is applied to a particular column of antenna elements in the array will be produced solely by the phase shifter 17 with which that column is coupled. It is therefore seen that the sequence of columns in the array is controlled by a sequence of the phase shifters 17 and their respective ferrite rods 30. The sequence of the columns in the array may be defined as the sequence of the elements in each of the rows of elements in the array. For example, in the array shown in FIG. 1, row 14-6 of the array is shown as having eight successive radiating elements 14 (one element from each of the columns 14A through 14H). Therefore the sequence of columns in the array, running from right to left in FIG. 1, is 14A, 14B, 14C and so on until 14H. Similarly, the sequence of the phase shifters 17 which control the columns in the array is 17A, 17B, 17C and so on to 17H.

In order to scan the antenna beam in the X—X plane, the antenna array of the invention provides means for simultaneously magnetically biasing all of the rods 30 of the phase shifters 17 along the longitudinal axes of the rods to create magnetic biasing fields in the rods having simultaneous magnitudes which progressively increase from rod to rod in accordance with the sequential position of the rod in the sequence of rods. This is accomplished, as shown in FIG. 6 of the drawings, by providing each of the phase shifters 17A through 17H with a helical biasing coil 44 which has a number of turns which depends upon the position of the phase shifter in the sequence of shifters and rods and by connecting all of the helical biasing coils in series circuit so that they will be energized by the same current at the same time. Furthermore, the numbers of turns of the biasing coils 44A through 44H are related to each other by an arithmetic progression in which the number of turns of the biasing coil for each of the rods 30A through 30H in the sequence of rods differs from the number of turns of the biasing coil for the adjacent rod in the sequence of rods by a constant amount. For example, as seen in FIGS. 1 and 6, it will be observed that phase shifter 17A is provided with a coil having one turn, phase shifter 17B is provided with a coil having two turns, phase shifter 17C is provided with a coil having three turns and so forth until the eighth phase shifter 17H is seen as having a coil which is provided with eight turns. Accordingly, when a scanning control or drive current, indicated by the arrows 48, is passed through the single scanning control for drive wire 29 which serially interconnects all of the biasing coils, the simultaneous magnitudes of the magnetic biasing fields created in the sequence of rods 30A through 30H are related to each other by an arithmetic progression in which the magnitude of the magnetic biasing field in each rod in the sequence of rods differs from the magnitude of the magnetic biasing field in an adjacent rod by a constant amount. Since the magnitude of the magnetic biasing field created in each phase shifter 17 determines the amount of the phase shift introduced by that phase shifter to the column of the antenna array which that shifter controls, it is apparent that there will be a constant phase shift differential between adjacent phase shifters in the sequence of rods and shifters which control the array. Accordingly, as a scanning control or drive current is introduced into the drive wire 29 and gradually increased, the antenna beam will be swept in the X—X plane. Although an arithmetic progression of 1, 2, 3, 4–8 turns has been illustrated for the biasing coils, it will be apparent that other and different arithmetic progressions could be employed such as 2, 4, 6, 8–16 turns, for example, to accomodate the magnitude of the scanning control or drive current available.

It should be noted that although the antenna array of the invention has been illustrated and described as being mounted on a dielectric substrate 10 having planar top and bottom surfaces 11 and 12, respectively, the array is conformal or bendable to some degree. The top and bottom surfaces of the substrate may be sections of cylindrical surfaces having major axes which are parallel to the longitudinal axes of the columns of elements 14 and to the longitudinal axes of the rods 30 of the phase shifters 17. The amount of curvature of the surfaces of the substrate and of the array are limited, however, because the greater the degree of curvature of the surface the wider will be the antenna beam produced and more and more elements must be added to each column of the array and more columns added to the array to maintain the pencil-shaped beam desired. Accordingly, there is a "trade off" between the degree of curvature of the array and the overall size of the array as determined by the number of radiating elements and columns.

It is believed apparent that many changes could be made in the construction and described uses of the foregoing microstrip phase scan antenna array and many seemingly different embodiments of the invention could be constructed without departing from the scope itself. Accordingly, it is intended that all matter contained in the above description or shown in the accompanying drawings shall be interpreted as illustrative and not in a limiting sense.

What is claimed is:

1. A microstrip phase scan antenna array for planar radar scanning with a substantially pencil-shaped beam comprising a microstrip transmission line dielectric substrate having top and bottom surfaces;

an electrically conductive ground plane mounted on the bottom surface of said substrate;

a plurality of microstrip antenna radiating elements mounted on the top surface of said substrate in a columnar array of columns and rows of said elements for radiating a substantially pencil-shaped beam in a first plane which is perpendicular to said columns of elements and in a second plane which is perpendicular to said first plane when the elements in each of said columns are serially interconnected and all of said columns are coupled to a source of millimeter wave energy, the sequence of the elements in each of said rows of elements defining the sequence of said columns in said array;

a plurality of rectangular ferrite rods mounted on the top surface of said substrate, the number of said rods being equal to the number of said columns in said array, each of said rods having a first rod side thereof mounted on the top surface of said substrate, a dielectric constant which is greater than the dielectric constant of said substrate, a dielectric plate mounted thereon having top and bottom surfaces and a dielectric constant which is substantially the same as the dielectric constant of said substrate, said plate extending the length of the rod and having the bottom surface thereof mounted on another side of the rod which is parallel to said first rod side, a pair of ramp-shaped dielectric waveguide members mounted on the top surface of said substrate at opposite ends of the rod, each of said ramp-shaped members having a dielectric constant which is substantially the same as the dielectric constant of the rod, a bottom surface abutting the top surface of said substrates and a downwardly-sloping top surface extending between the end of said plate and the top surface of said substrate, and a length of electrically conductive microstrip conductor mounted on the top surfaces of said ramp-shaped members and the top surface of said plate and having an input end and an output end;

means mounted on said substrate for serially interconnecting the elements in each of said columns of elements;

means mounted on said substrate for supplying the input ends of the microstrip conductor lengths associated with said plurality of rods with millimeter wave energy of equal amplitude and phase and for coupling the output end of each of said conductor lengths to a different one of said columns of elements so that the sequence of columns in said array is coupled to a sequence of said rods; and means for simultaneously magnetically biasing all of said rods along the longitudinal axes thereof to create magnetic biasing fields in the rods having simultaneous magnitudes which progressively increase from rod to rod in accordance with the sequential position of the rod in said sequence of rods.

2. A microstrip phase scan antenna array as claimed in claim 1 wherein said microstrip antenna radiating elements are microstrip patch radiators.

3. A microstrip phase scan antenna array as claimed in claim 1 wherein the simultaneous magnitudes of the magnetic biasing fields created in said sequence of rods are related to each other by an arithmetic progression in which the magnitude of the magnetic biasing field in each rod in said sequence of rods differs from the magnitude of the magnetic biasing field in an adjacent rod in said sequence of rods by a constant amount.

4. A microstrip phase scan antenna array as claimed in claim 1 wherein said magnetic biasing means comprises a plurality of helical biasing coils, the number of said coils being equal to the number of said rods, each of said coils encircling a different one of said rods and the plate associated with that rod and extending along the length of the rod, the turns of each said coils passing through said substrate and said ground plane and being spaced a distance from the rod and the plate associated therewith, and means for connecting said plurality of biasing coils in series circuit for control by a source of bias voltage.

5. A microstrip phase scan antenna array as claimed in claim 4 wherein the numbers of turns of the biasing coils in said plurality of biasing coils are releated to each other by an arithmetic progression in which the number of turns of the biasing coil for each rod in said sequence of rods differs from the number of turns of the biasing coil for the adjacent rod in said sequence of rods by a constant amount.

6. A microstrip phase scan antenna array as claimed in claim 5 wherein each rod of said sequence of rods has the longitudinal axis of the rod aligned with the longitudinal axis of the column of antenna radiating elements to which the rod is coupled.

7. A microstrip phase scan antenna array as claimed in claim 6 wherein the top and bottom surfaces of said substrate are each planar.

* * * * *